US011639621B2

(12) United States Patent
Yun

(10) Patent No.: US 11,639,621 B2
(45) Date of Patent: May 2, 2023

(54) HOLD-OPEN LATCH STRUCTURE FOR OPPOSITE SLIDING DOORS FOR VEHICLE

(71) Applicants: Hyundai Motor Company, Seoul (KR); Kia Motors Corporation, Seoul (KR)

(72) Inventor: Hyung-In Yun, Seoul (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 1055 days.

(21) Appl. No.: 16/382,931

(22) Filed: Apr. 12, 2019

(65) Prior Publication Data

US 2020/0217112 A1 Jul. 9, 2020

(30) Foreign Application Priority Data

Jan. 7, 2019 (KR) ..... 10-2019-0001899

(51) Int. Cl.

| | |
|---|---|
| ***E05B 83/40*** | (2014.01) |
| ***E05B 79/20*** | (2014.01) |
| ***E05B 85/24*** | (2014.01) |
| ***E05C 17/60*** | (2006.01) |
| ***E05B 85/04*** | (2014.01) |
| *E05C 7/00* | (2006.01) |

(52) U.S. Cl.

CPC ..... *E05B 83/40* (2013.01); *E05B 79/20* (2013.01); *E05B 85/045* (2013.01); *E05B 85/24* (2013.01); *E05C 17/60* (2013.01); *E05C 2007/007* (2013.01)

(58) Field of Classification Search

CPC ..... E05C 17/025; E05C 17/60; E05B 83/40; E05B 83/36; E05B 79/20; E05B 63/0004; E05B 63/0008; E05B 85/20; E05B 85/24; E05B 85/26; Y10S 292/23; Y10S 292/46

See application file for complete search history.

(56) References Cited

U.S. PATENT DOCUMENTS 5,896,704 A * 4/1999 Neag ..... E05D 15/1081 49/223
5,967,595 A * 10/1999 Heya ..... B60J 5/06 49/213

(Continued)

FOREIGN PATENT DOCUMENTS

AU 2021102453 A4 * 7/2021
CN 104675227 A 6/2015

(Continued)

*Primary Examiner* — Alyson M Merlino
(74) *Attorney, Agent, or Firm* — Slater Matsil, LLP

(57) ABSTRACT

A hold-open latch structure for opposite sliding doors for a vehicle includes a roller mechanism swing arm which rotates about a rotating shaft formed in a roller mechanism at the time of opening or closing the door, and moves the door toward the inside and outside of the vehicle and in a longitudinal direction of the vehicle. A locking unit enables the door to be opened or closed and maintains an opened state of the door. The locking unit further includes a catch pivotably mounted on the rotating shaft and coupled to the roller mechanism swing arm so as to rotate together with the roller mechanism swing arm at the time of opening or closing the door. A lever is mounted so that one side of the lever is in contact with the catch.

20 Claims, 5 Drawing Sheets

(56) References Cited

U.S. PATENT DOCUMENTS

| | | | | |
|---|---|---|---|---|
| 6,183,039 | B1 * | 2/2001 | Kohut | E05D 15/1081 296/146.12 |
| 7,954,880 | B2 * | 6/2011 | Kunishima | B60J 5/06 296/146.12 |
| 9,499,031 | B2 * | 11/2016 | Choi | B60J 5/06 |
| 9,540,851 | B2 * | 1/2017 | Lee | E05B 83/04 |
| 9,545,834 | B2 * | 1/2017 | Choi | B60J 5/06 |
| 10,024,084 | B2 | 7/2018 | Choi | |
| 2006/0059783 | A1 * | 3/2006 | Braun | E05B 83/40 49/360 |
| 2015/0152673 | A1 | 6/2015 | Lee | |

FOREIGN PATENT DOCUMENTS

| | | | | |
|---|---|---|---|---|
| DE | 29819083 | U1 * | 2/1999 | B60J 5/06 |
| KR | 20120054801 | A * | 5/2012 | |
| KR | 101786663 | B1 | 10/2017 | |

* cited by examiner

Fig. 2A
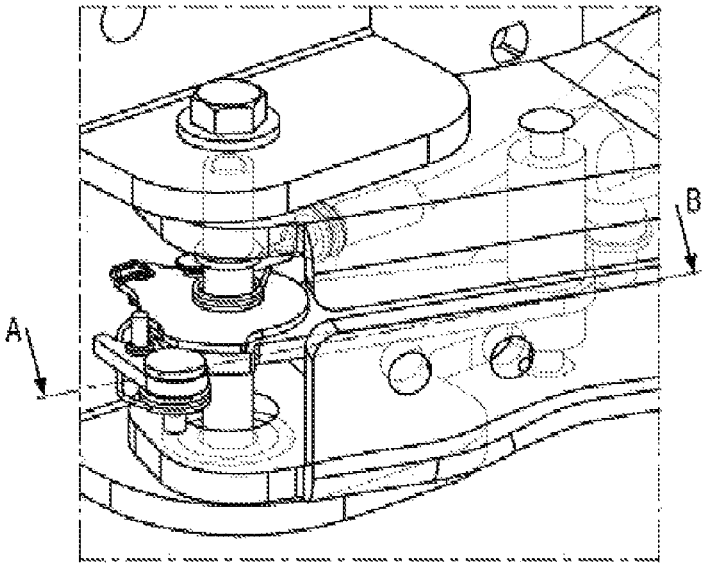
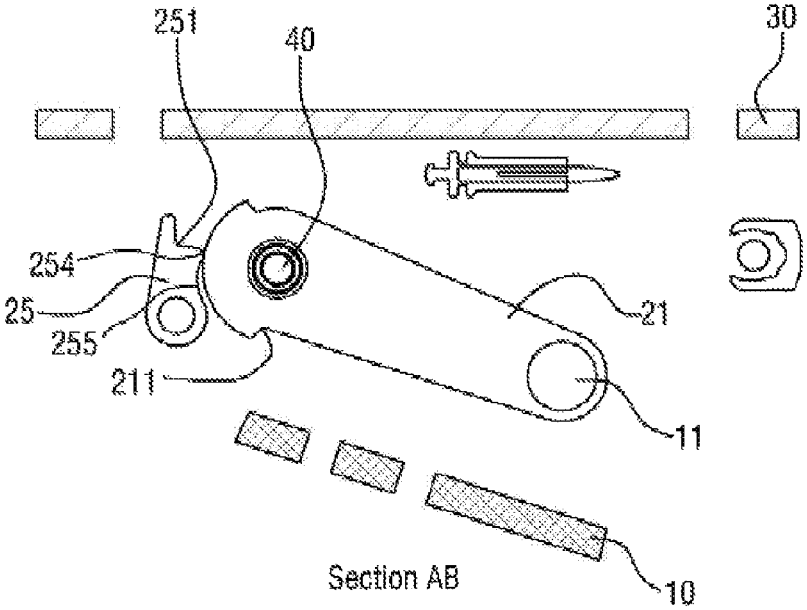
Fig. 2B

Fig. 3A
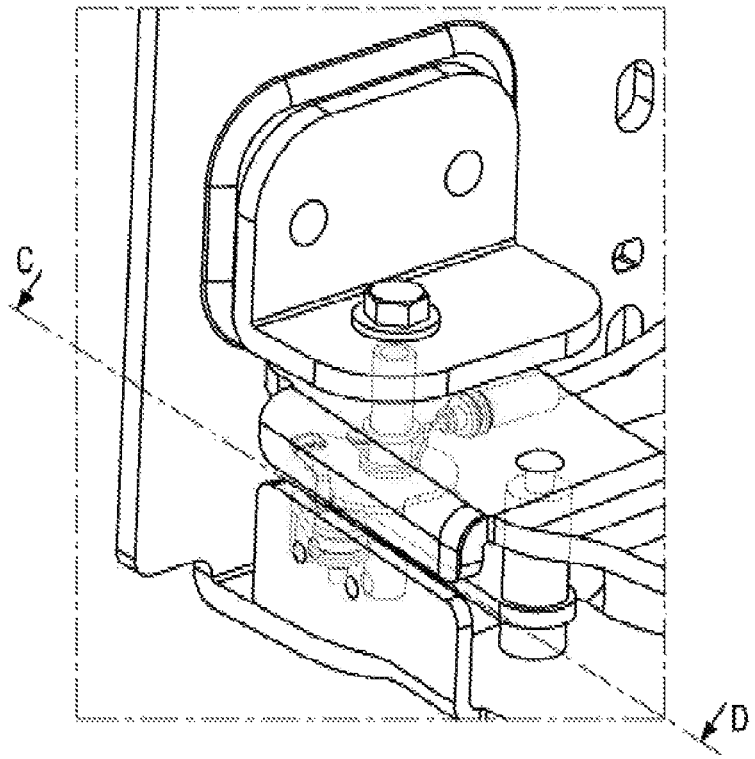
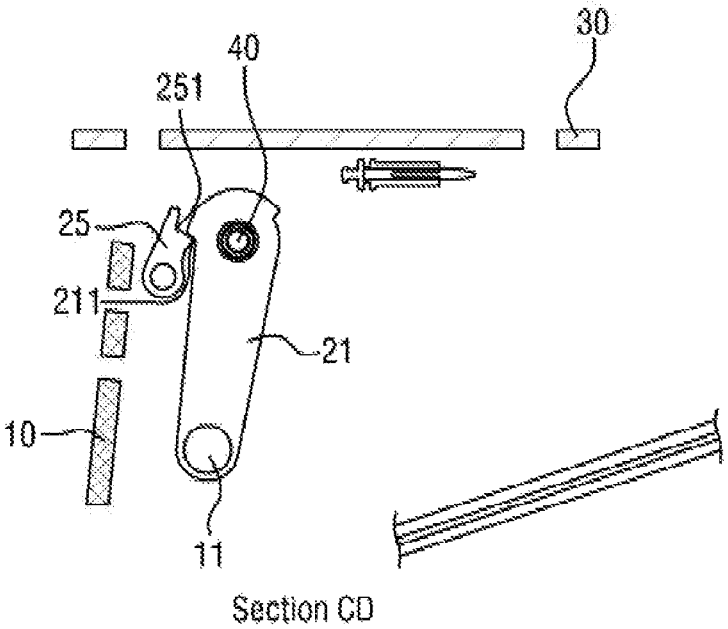
Fig. 3B

HOLD-OPEN LATCH STRUCTURE FOR OPPOSITE SLIDING DOORS FOR VEHICLE

CROSS-REFERENCE TO RELATED APPLICATIONS

This application claims priority to Korean Patent Application No. 10-2019-0001899, filed in the Korean Intellectual Property Office on Jan. 7, 2019, which application is hereby incorporated herein by reference.

TECHNICAL FIELD

The present invention relates to a hold-open latch structure for opposite sliding doors for a vehicle.

BACKGROUND

In general, in the case of a passenger vehicle, doors of a vehicle include a front door installed at a front side in a longitudinal direction of the vehicle and a rear door installed at a rear side in the longitudinal direction of the vehicle. The front door and the rear door are typically installed on the vehicle body so as to be rotatable by means of hinges.

Recently, a necessity of completely opening a door opening to allow a disabled person to be easily seated in the vehicle and make it easy to load articles becomes a serious issue, and as a result, it is necessary to install the sliding door in a passenger vehicle as well as a van. Further, there is a need to develop a latch device that enables the sliding door to be opened or closed and maintains an opened or closed state of the sliding door.

In this regard, Korean Patent No. 10-1786663 and U.S. Pat. No. 10,024,084 (Sliding Door Latch for Vehicle) in the related art relates to a latch for enabling a sliding door for a vehicle to be opened or closed, and more particularly, discloses a sliding door latch for a vehicle which includes: a striker which is mounted on an inner surface of each of front and rear sliding doors which faces an occupant compartment; a latch unit which catches and fixes the striker or releases the striker; and a release unit which releases the latch unit by a manipulation of a door handle installed on each of the front sliding door and the rear sliding door.

However, there is a problem in the related art in that because a roller allows the door to be moved only in a longitudinal direction of a vehicle, a separate link is required to move the door toward the inside and outside of the vehicle.

There is a problem in the related art in that because the striker for fixing the latch is separately mounted on the door, a large space is required to mount the latch and the striker.

There are problems in that because the latch is mounted at an upper side of the roller mechanism, the volume of space occupied by the roller mechanism and the latch is increased, and a step height is increased when a user gets in the vehicle.

SUMMARY

Embodiments of the present invention relate to a hold-open latch structure for opposite sliding doors for a vehicle which is mounted on the opposite sliding doors to allow the door to be opened only in case of necessity and to prevent the door from being arbitrarily opened or closed, maintains an opened state of the door when the door is completely opened. In particular embodiments, the present invention relates to a hold-open latch structure for opposite sliding doors for a vehicle in which a locking unit is configured such that the locking unit is operable without a separate striker and the locking unit is mounted in a roller so that a volume of the roller mechanism is reduced.

Embodiments of the present invention have been made in an effort to provide a hold-open latch structure for opposite sliding doors for a vehicle in which a locking unit is configured such that the locking unit is mounted in a roller in a hold-open latch structure for opposite sliding doors for a vehicle in the related art, and as a result, a volume of the roller mechanism is reduced, and the locking unit is configured to be operable without a separate striker.

An exemplary embodiment of the present invention provides a hold-open latch structure for opposite sliding doors for a vehicle. The hold-open latch structure includes a roller swing arm which rotates about a rotating shaft formed in a roller mechanism at the time of opening or closing the door, and moves the door toward the inside and outside of the vehicle and in a longitudinal direction of the vehicle. A locking unit enables the door to be opened or closed and maintains an opened state of the door. The locking unit further includes a catch which is pivotably mounted on the rotating shaft and coupled to the roller mechanism swing arm so as to rotate together with the roller swing arm at the time of opening or closing the door; and a lever which is mounted so that one side of the lever is in contact with the catch. The lever has a catching groove that fixes the catch at a predetermined angle and prevents a rotation of the catch. The locking unit is mounted in the roller mechanism.

The roller mechanism swing arm may be pivotably connected to a mounting bracket through the rotating shaft, the mounting bracket fixing the roller mechanism to the door or a vehicle body.

The catch may be coupled to the roller mechanism swing arm through a rigid column that vertically penetrates the roller mechanism swing arm.

When the door is completely opened, the lever may maintain an opened state of the door as the catch is caught by the catching groove.

The locking unit may further include a lever cam which is pivotably mounted on the rotating shaft and rotates the lever to release the catch from the catching groove at the time of closing the door.

The lever may have a catching column which is in contact with an extension portion of the lever cam, such that the lever rotates in a direction opposite to the rotation direction of the lever cam as the lever cam rotates.

One side of the lever cam may be connected to a cable to be pulled by an operation of closing the door.

The lever may further include a lever return spring which returns the lever to an original position.

The lever cam may further include a lever cam return spring which returns the lever cam to an original position.

According to the present invention having the aforementioned configuration, a roller swing arm, which moves the door toward the inside and outside of the vehicle and in the longitudinal direction of the vehicle, is provided, and as a result, there are advantages in that it is not necessary to provide a separate link for moving the door toward the inside and outside of the vehicle, such that an overall layout of the roller mechanism is simplified, and costs are reduced.

According to the present invention, there is an advantage in that the catch and the groove formed in the lever may maintain an opened state of the door without a separate striker.

According to the present invention, the locking unit is positioned in the roller mechanism, and as a result, there are advantages in that an increase in step height is prevented and a volume of the roller mechanism is decreased.

BRIEF DESCRIPTION OF THE DRAWINGS

FIG. 2A is a perspective view of the hold-open latch structure for opposite sliding doors for a vehicle according to the present invention when the door is in a closed state.

FIG. 2B is a cut-away view taken along line A-B in FIG. 2A.

FIG. 3A is a perspective view of the hold-open latch structure for opposite sliding doors for a vehicle according to the present invention when the door is in an opened state.

FIG. 3B is a cut-away view taken along line C-D in FIG. 3A.

DETAILED DESCRIPTION OF ILLUSTRATIVE EMBODIMENTS

Figure 1:
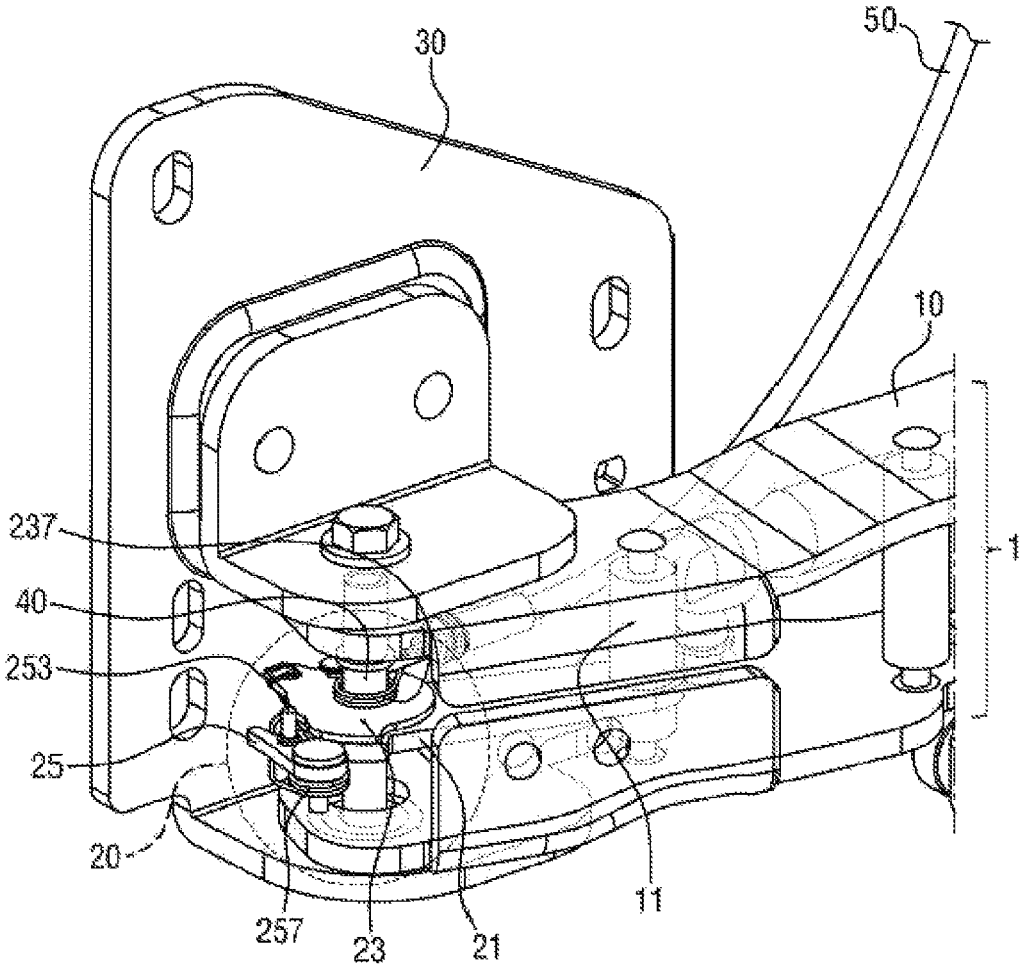
FIG. 1 is a perspective view of a hold-open latch structure for opposite sliding doors for a vehicle according to the present invention.

Hereinafter, the present invention will be described in detail with reference to the accompanying drawings. However, the present invention is not restricted or limited by exemplary embodiments. Like reference numerals indicated in the respective drawings refer to members which perform substantially the same functions.

An object and an effect of the present invention may be naturally understood or may become clearer from the following description, and the object and the effect of the present invention are not restricted only by the following description. In addition, in the description of the present invention, the specific descriptions of publicly known technologies related with the present invention will be omitted when it is determined that the specific descriptions may unnecessarily obscure the subject matter of the present invention.

FIG. 1 is a perspective view of a hold-open latch structure for opposite sliding doors for a vehicle according to the present invention.

Referring to FIG. 1, the hold-open latch structure for opposite sliding doors for a vehicle according to the present invention may include a roller 1 and a mounting bracket 30.

The roller mechanism 1 includes a roller swing arm 10 and a locking unit 20. Since the locking unit 20 is positioned in the roller mechanism 1, an increase in step height may be prevented and a volume of the roller mechanism 1 may be reduced.

At the time of opening or closing the door, the roller mechanism swing arm 10 may rotate about a rotating shaft 40 formed in the roller mechanism 1 and move the door toward the inside and outside of the vehicle and in a longitudinal direction of the vehicle.

Since the roller mechanism swing arm 10 is configured to rotate, it is possible to move the door in the longitudinal direction of the vehicle without a separate link structure even though the roller mechanism 1 moves in a state of being coupled to a curved rail instead of a rectilinear rail.

The roller mechanism swing arm 10 may move the door toward the outside of the vehicle when opening the door and the roller mechanism swing arm 10 may move the door toward the inside of the vehicle when closing the door.

The mounting bracket 30 may be attached to any of the door and the vehicle body in accordance with a mounting position of the roller mechanism 1.

The roller mechanism swing arm 10 is pivotably connected to the mounting bracket 30 through the rotating shaft 40, thereby rotating the door about the rotating shaft 40. The roller mechanism swing arm 10 may be connected to the mounting bracket 30 in order to fix the roller mechanism 1 to the door or the vehicle body.

The locking unit 20 enables the door to be opened or closed and maintains an opened state of the door. The locking unit 20 may include a catch 21 and a lever 25.

Like the roller mechanism swing arm 10, the catch 21 is pivotably mounted on the rotating shaft 40. The catch 21 may be coupled to the roller mechanism swing arm 10 and rotated together with the roller mechanism swing arm 10 at the time of opening or closing the door.

Any part, except for the roller mechanism swing arm 10 and the rotating shaft 40, may be coupled to the catch 21. However, the catch 21 may be coupled to the roller mechanism swing arm 10 through a rigid column 11 which is mounted to vertically penetrate the roller mechanism swing arm 10 in order to improve rigidity of the roller mechanism swing arm 10.

The lever 25 is mounted at a lateral side of the catch 21 so that one side of the lever 25 is in contact with the catch 21. The lever 25 may have a catching groove 251 (see FIG. 2B) which may fix the catch 21 at a predetermined angle and prevent a rotation of the catch 21. The lever 25 may be mounted in the roller mechanism 1 such that the lever 25 may rotate about an axis separated from the axis of the catch 21.

The catch 21 may have a catching projection 211 (see FIG. 2B) that corresponds to the catching groove 251 so that the catching projection 211 may be caught by the catching groove 251 at a predetermined angle.

As described below in detail, when the door is completely opened, the catching groove 251 may allow the catch 21 to be caught by the catching groove 251, thereby maintaining the opened state of the door.

The locking unit 20 may further include a lever cam 23 which is pivotably mounted on the rotating shaft 40 like the catch 21. The lever cam 23 releases the catch 21 from the catching groove 251 by rotating the lever 25 at the time of closing the door.

The lever 25 may have a catching column 253 which is in contact with an extension portion 231 formed at one side of the lever cam 23.

When the user attempts to close the door by operating the lever cam 23, the lever cam 23 rotates to push the catching column 253 in a direction opposite to the rotation direction, such that the lever 25 rotates in the direction opposite to the rotation direction of the lever cam 23. Therefore, the catch 21 fixed to the catching groove 251 is released from the catching groove 251, such that the locking unit 20, which maintains the opened state of the door, is unlocked.

One side of the lever cam 23 is connected to a cable 50 to be pulled by an operation of closing the door, and the cable 50 is connected to a switch or the like that performs an operation of opening or closing the door, such that the lever cam 23 may be rotated when the user attempts to close the door.

The lever 25 may include a lever return spring 257 that returns the lever 25 to an original position. The lever cam 23 may further include a lever cam return spring 237 that returns the lever cam 23 to an original position.

FIG. 2A is a perspective view of the hold-open latch structure for opposite sliding doors for a vehicle according to the present invention when the door is in a closed state, and FIG. 2B is a cut-away view taken along line A-B in FIG. 2A.

Referring to FIG. 2B, the catch 21 and the roller mechanism swing arm 10, which are coupled to each other through the rigid column 11 so as to be pivotable about the rotating shaft 40, may have the same angle when the door is in the closed state.

In this case, the catch 21 is in a free state in which the lever 25 does not restrict the catch 21 and one side of the catch 21 is not caught by the catching groove 251.

FIG. 3A is a perspective view of the hold-open latch structure for opposite sliding doors for a vehicle according to the present invention when the door is in an opened state, and FIG. 3B is a cut-away view taken along line C-D in FIG. 3A.

Referring to FIG. 3B, the catch 21 is rotated clockwise in accordance with the rotation of the roller mechanism swing arm 10, and the catching projection 211, which is formed at one side of the catch 21 so as to correspond to the catching groove 251, is caught by the catching groove 251.

Therefore, the opened state of the door may be maintained without a separate striker.

The catching projection 211 formed on the catch 21 may be provided at a position on the catch 21 which corresponds to a rotation angle of the roller mechanism swing arm 10 which is calculated when the door is completely opened.

Figure 4:
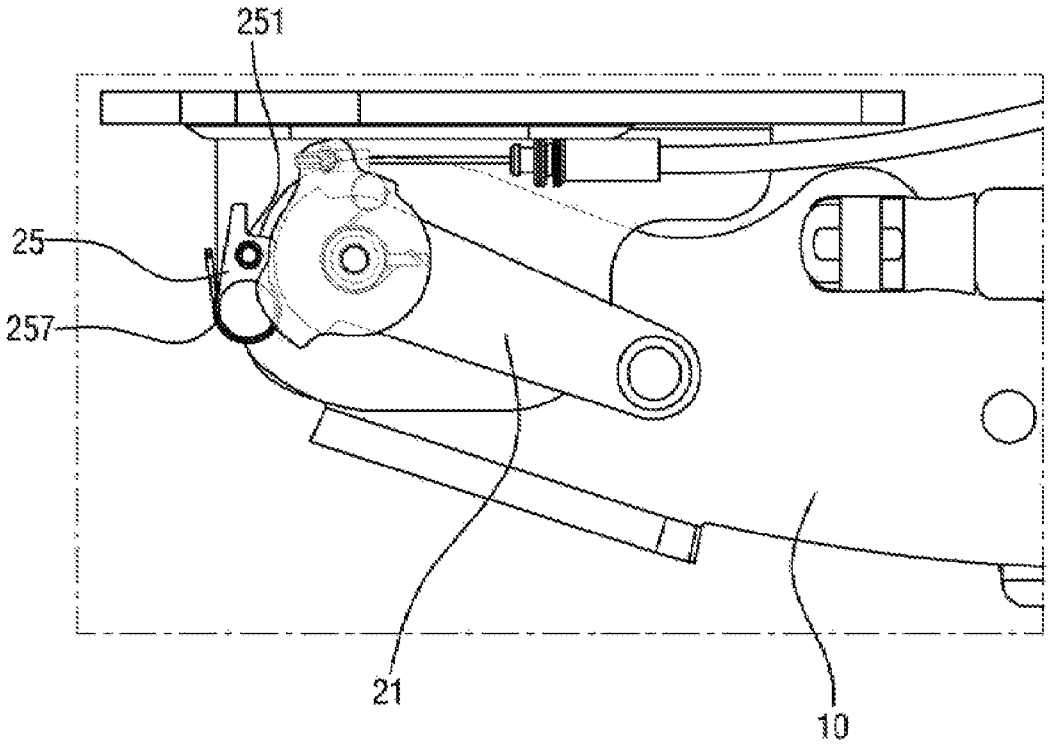
FIG. 4 is a top plan view of a locking unit according to the present invention when the door is in a closed state.

FIG. 4 is a top plan view of the locking unit 20 according to the present invention when the door is in the closed state.

Referring to FIG. 4, when the user attempts to open the door in the state in which the door is in the closed state, the lower swing arm rotates clockwise first.

As the lower swing arm rotates, the catch 21, which is coupled to the lower swing arm through the rigid column 11, rotates at the same angle as the lower swing arm.

In this case, as the catch 21 rotates, the catch 21, which is in contact with a protruding portion 254 (see FIG. 2B) of the lever 25, comes into contact with a curved portion 255 (see FIG. 2B) formed to correspond to a cross section of the catch 21.

When the catch 21 further rotates, the catching projection 211 formed on the catch 21 comes into contact with the protruding portion 254. When the catching projection 211 passes the protruding portion 254, the lever 25 rotates counterclockwise at the same time by elastic force of the lever return spring.

Figure 5:
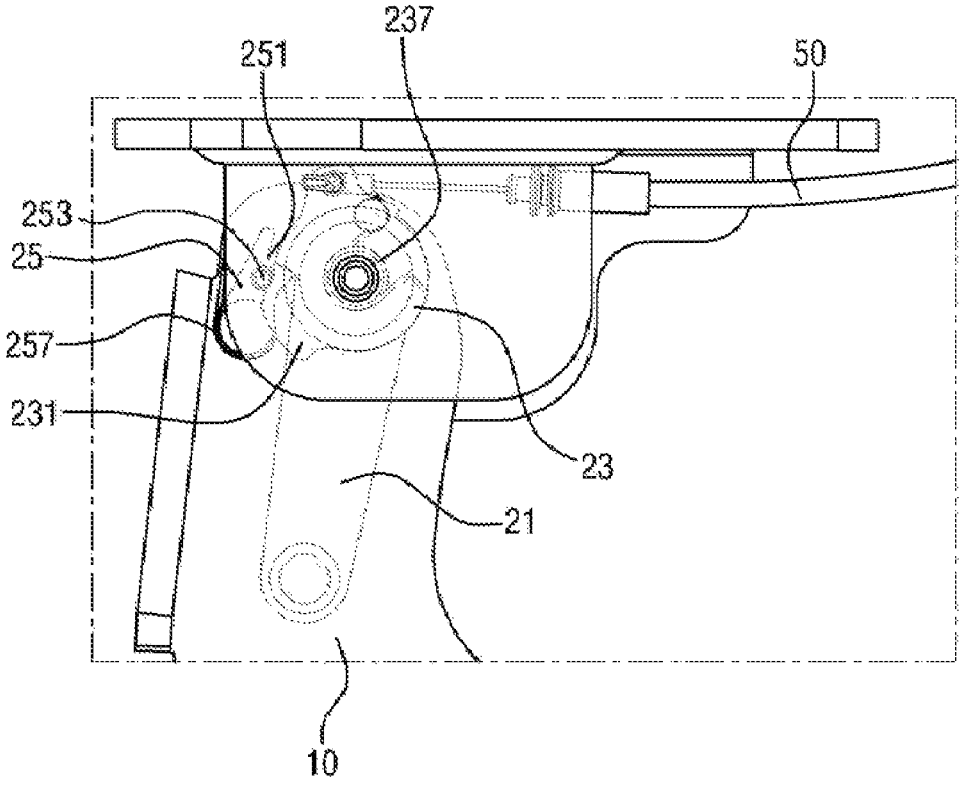
FIG. 5 is a top plan view of the locking unit according to the present invention when the door is in an opened state.

FIG. 5 is a top plan view of the locking unit 20 according to the present invention when the door is in the opened state.

Referring to FIG. 5, when the door is completely opened, the catch 21 and the lever 25 cannot rotate despite the elastic force of the lever return spring because the catching groove 251 and the catching projection 211 of the catch 21 are caught by each other.

In this case, when the cable 50 is pulled in a right direction as the user attempts to close the door, the lever cam 23 rotates clockwise.

As the lever cam 23 rotates clockwise, the extension portion 231 of the lever cam 23 pushes the catching column 253 of the lever 25, such that the lever 25 rotates in the direction opposite to the rotation direction of the lever cam 23 while overcoming the elastic force of the lever return spring.

As the lever 25 rotates in the direction opposite to the rotation direction of the lever cam 23, the catch 21 caught by the catching groove 251 becomes free and rotates counterclockwise together with the roller mechanism swing arm 10, such that the door may return to the closed state.

While the present invention has been described in detail above with reference to the representative exemplary embodiment, those skilled in the art to which the present invention pertains will understand that the exemplary embodiment may be variously modified without departing from the scope of the present invention. Accordingly, the scope of the present invention should not be limited to the described exemplary embodiment, but should be defined not only by the appended claims but also by all changes or modified forms induced from an equivalent concept to the claims.

What is claimed is:

1. A hold-open latch structure for one door of a pair of opposite sliding doors for a vehicle, the hold-open latch structure comprising:

a roller swing arm that is rotatable, at a time of opening or closing of the one door, about a rotating shaft located in a roller mechanism, wherein the roller swing arm is configured to move the one door toward an inside and an outside of the vehicle and in a longitudinal direction of the vehicle; and a locking unit configured to enable the one door to be closed and to maintain an opened state of the one door, wherein the locking unit includes:

a catch that is pivotably mounted on the rotating shaft and coupled to the roller swing arm so as to rotate together with the roller swing arm at the time of opening or closing the one door, wherein the catch is coupled to the roller swing arm through a rigid column that vertically penetrates the roller swing arm; and a lever that is mounted so that one side of the lever is in contact with the catch, the lever having a catching groove that is configured to fix the catch at a predetermined angle and prevent a rotation of the catch, thereby maintaining the opened state of the one door.

2. The hold-open latch structure of claim 1, wherein the locking unit is mounted in the roller mechanism.

3. The hold-open latch structure of claim 1, wherein the roller swing arm is pivotably connected to a mounting bracket through the rotating shaft and wherein the mounting bracket fixes the roller mechanism to the one door or a vehicle body.

4. The hold-open latch structure of claim 1, wherein, when the one door is in the opened state, the lever maintains the opened state of the one door by the catch being caught by the catching groove.

5. The hold-open latch structure of claim 1, wherein the locking unit further includes a lever cam that is pivotably mounted on the rotating shaft and is configured to rotate the lever to release the fixation of the catch by the catching groove at the time of closing the one door.

6. The hold-open latch structure of claim 5, wherein the lever has a catching column that is in contact with an extension portion of the lever cam, such that the lever is rotatable in a direction opposite to a rotation direction of the lever cam as the lever cam rotates.

7. The hold-open latch structure of claim 5, wherein one side of the lever cam is connected to a cable to be pulled during an operation of closing the one door.

8. The hold-open latch structure of claim 5, wherein the lever cam further includes a lever cam return spring configured to return the lever cam to an original position.

9. The hold-open latch structure of claim 1, wherein the lever further includes a lever return spring configured to return the lever to an original position.

10. A vehicle comprising:

a vehicle body;

a vehicle door slidably attached to the vehicle body;

a roller mechanism;

a rotating shaft located in the roller mechanism;

a roller swing arm that is rotatable about the rotating shaft at a time of opening or closing the vehicle door, wherein the roller swing arm is configured to move the vehicle door toward an inside and an outside of the vehicle body and in a longitudinal direction of the vehicle body; and a locking unit mounted in the roller mechanism and configured to enable the vehicle door to be closed and to maintain an opened state of the vehicle door, wherein the locking unit includes:

a catch that is pivotably mounted on the rotating shaft and coupled to the roller swing arm so as to rotate together with the roller swing arm at the time of opening or closing the vehicle door, wherein the catch is coupled to the roller swing arm through a rigid column that vertically penetrates the roller swing arm; and a lever that is mounted so that one side of the lever is in contact with the catch, the lever having a catching groove that is configured to fix the catch at a predetermined angle and prevent a rotation of the catch, thereby maintaining the opened state of the vehicle door.

11. The vehicle of claim 10, wherein the roller swing arm is pivotably connected to a mounting bracket through the rotating shaft, the mounting bracket fixing the roller mechanism to the vehicle door or the vehicle body.

12. The vehicle of claim 10, wherein, when the vehicle door is in the opened state, the lever maintains the opened state of the vehicle door by the catch being caught by the catching groove.

13. The vehicle of claim 10, wherein the locking unit further includes a lever cam that is pivotably mounted on the rotating shaft and is configured to rotate the lever to release the fixation of the catch by from the catching groove at the time of closing the vehicle door.

14. The vehicle of claim 13, wherein the lever has a catching column that is in contact with an extension portion of the lever cam, such that the lever is rotatable in a direction opposite to a rotation direction of the lever cam as the lever cam rotates.

15. The vehicle of claim 13, wherein one side of the lever cam is connected to a cable to be pulled during an operation of closing the vehicle door.

16. The vehicle of claim 13, wherein the lever cam further includes a lever cam return spring configured to return the lever cam to an original position.

17. The vehicle of claim 10, wherein the lever further includes a lever return spring configured to return the lever to an original position.

18. A hold-open latch structure for one door of a pair of opposite sliding doors for a vehicle, the hold-open latch structure comprising:

a roller swing arm that is rotatable, at a time of opening or closing of the one door, about a rotating shaft located in a roller mechanism, wherein the roller swing arm is configured to move the one door toward an inside and an outside of the vehicle and in a longitudinal direction of the vehicle; and a locking unit configured to enable the one door to be closed and to maintain an opened state of the one door, wherein the locking unit includes:

a catch that is pivotably mounted on the rotating shaft and coupled to the roller swing arm so as to rotate together with the roller swing arm at the time of opening or closing the one door;

a lever that is mounted so that one side of the lever is in contact with the catch, the lever having a catching groove that is configured to fix the catch at a predetermined angle and prevent a rotation of the catch, thereby maintaining the opened state of the one door; and a lever cam that is pivotably mounted on the rotating shaft and is configured to rotate the lever to release the fixation of the catch by the catching groove at the time of closing the one door, wherein the lever has a catching column that is in contact with an extension portion of the lever cam, such that the lever is rotatable in a direction opposite to a rotation direction of the lever cam as the lever cam rotates.

19. The hold-open latch structure of claim 18, wherein the locking unit is mounted in the roller mechanism.

20. The hold-open latch structure of claim 18, wherein the roller swing arm is pivotably connected to a mounting bracket through the rotating shaft, the mounting bracket fixes the roller mechanism to the one door or a vehicle body.

* * * * *